United States Patent [19]

Trenner

[11] Patent Number: 4,544,006

[45] Date of Patent: Oct. 1, 1985

[54] APPARATUS FOR FILLING DISPENSING CONTAINERS WITH A LIQUID OR PASTY PRODUCT

[75] Inventor: Hans-Herbert Trenner, Hamburg, Fed. Rep. of Germany

[73] Assignee: Colgate-Palmolive Company, New York, N.Y.

[21] Appl. No.: 528,681

[22] Filed: Sep. 1, 1983

[51] Int. Cl.[4] ..... B65B 3/04

[52] U.S. Cl. ..... 141/105; 141/263; 141/375

[58] Field of Search ..... 141/369, 376, 378, 391, 141/250–251, 260, 263, 264, 270, 285–288, 2, 18, 21, 25, 27, 100–103, 105, 59, 9

[56] References Cited

U.S. PATENT DOCUMENTS

| | | | |
|---|---|---|---|
| 1,537,170 | 5/1925 | Holmquist, Sr. | 141/103 |
| 1,820,480 | 8/1931 | O'Neil | 141/250 |
| 2,743,047 | 4/1956 | Clarke | 141/100 X |
| 2,839,094 | 6/1958 | Reno | 141/263 |
| 2,954,806 | 10/1960 | Kerr | 141/275 |
| 3,039,499 | 6/1962 | Peterson | 141/18 |
| 3,547,589 | 12/1970 | Rice et al. | 141/269 |
| 3,559,700 | 2/1971 | Erickson | 141/8 |
| 3,688,682 | 9/1972 | Good | 141/263 X |
| 3,756,290 | 9/1973 | Cleland et al. | 141/275 X |
| 3,881,529 | 5/1975 | Mannara | 141/100 |

FOREIGN PATENT DOCUMENTS

| | | | |
|---|---|---|---|
| 560107 | 7/1958 | Canada | 141/263 |
| 191419 | 9/1964 | Netherlands | 141/263 |
| 962757 | 7/1964 | United Kingdom . | |

*Primary Examiner*—Stephen Marcus
*Assistant Examiner*—Ernest G. Cusick
*Attorney, Agent, or Firm*—Herbert S. Sylvester; Murray M. Grill; John A. Stemwedel

[57] ABSTRACT

An apparatus for filling dispenser containers with a liquid or pasty product, having a filling station with a filling tube, which is inserted into the dispensing container by movement of the filling tube with respect to the dispensing container and a prechamber containing a filling product connected to the filling tube, characterized in that a telescopic tube coaxially reciprocatable with respect to the filling tube is provided in the latter, the upper end of tube being connected to the prechamber and being fixed to a piston which is sealingly guided with respect to filling tube, the lower end of which is movable through an opening in a bottom plate closing the lower end of the filling tube and that a restoring spring is provided between the piston and the bottom plate whose spring tension is less than the sum of the filling pressure of the filling product and frictional forces of telescopic tube.

8 Claims, 4 Drawing Figures

APPARATUS FOR FILLING DISPENSING CONTAINERS WITH A LIQUID OR PASTY PRODUCT

BACKGROUND OF THE INVENTION

The invention relates to an apparatus for filling dispensing containers (preferably cylindrical dispensing containers) with a liquid or pasty product, having a filling station with a filling tube, which is inserted into the dispensing container by a relative movement with respect to the latter, and a prechamber containing a filling product connected to the filling tube.

Such filling apparatuses can be designed in such a way that the filling tube is extended to the bottom of the dispensing container. However, such apparatuses are complicated and require both the filling tube to be extended for a long time and the container to remain in the vicinity of the filling station for a long period until the filled container is finally cleared.

In the case of simpler filling apparatuses, the filling tube is only partly extended into the dispensing container to be filled. However, this leads to turbulence and air pockets in the product to be filled and consequently either impairs the product due to oxidation or leads to a phase separation.

It is an object of the invention to provide an apparatus of the aforementioned type permitting a rapid filling directly at the bottom of the container and optionally an underlevel filling, without the hitherto necessary expenditure and effort in supplying the container to be filled to the filling station.

SUMMARY OF THE INVENTION

In accordance with the invention an apparatus for filling a dispensing container with a liquid or pasty product is provided having a filling station with a filling tube, which is insertable into the dispensing container by movement of the filling tube with respect to the dispensing container, and a prechamber containing a filling product connected to the filling tube, characterized in that a telescopic tube is provided which is coaxially reciprocatable with respect to the filling tube, the upper end oi the telescopic tube communicating with the prechamber and being fixed to a piston sealingly guided with respect to the filling tube and the lower end of which is movable through an opening in a bottom plate closing the lower end of the filling tube, and that a restoring spring is provided between the piston and the bottom plate, the tension of which is less than the sum of the filling pressure of the filled product and the frictional forces of the telescopic tube.

In another embodiment, it is possible to simultaneously fill a dispensing container with two different components, for example, two differently colored toothpastes. A further advantage of the inventive apparatus makes it possible to fill containers already internally equipped with a piston rod for a piston to be fitted after filling, without the piston rod impeding the filling process.

BRIEF DESCRIPTION OF THE DRAWING

The invention is described in greater detail hereinafter with reference to the accompanying drawings wherein.

DESCRIPTION OF THE PREFERRED DRAWING

Figure 1:
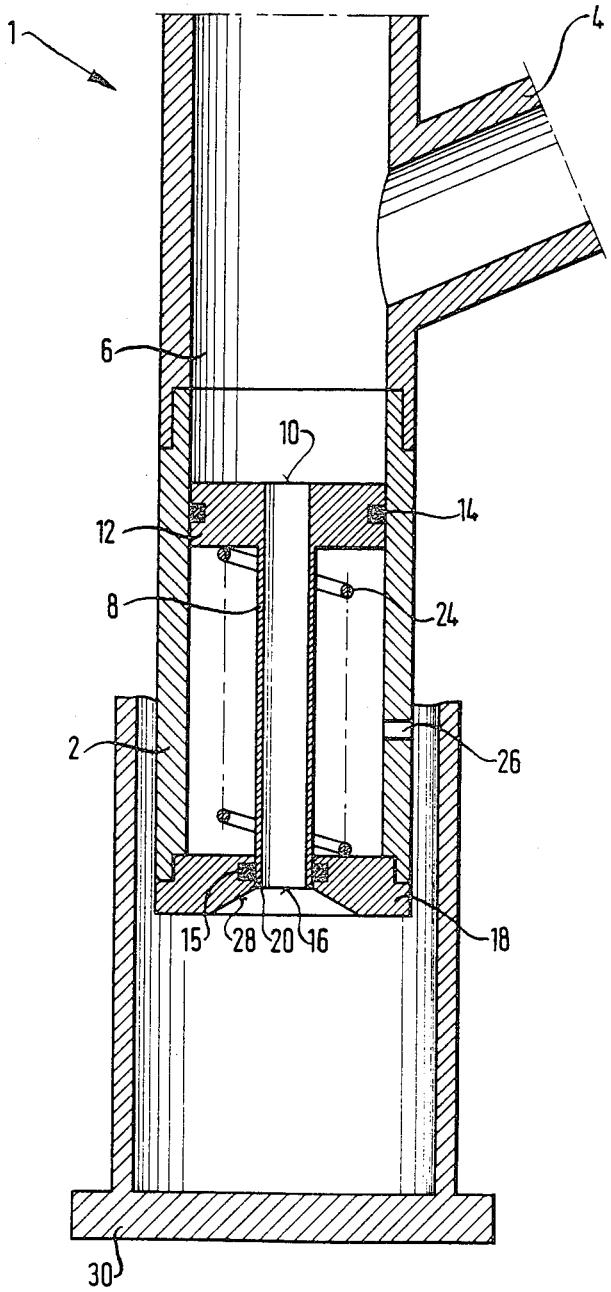
FIG. 1 is a sectional view of the filling apparatus of the invention.

In the apparatus shown in FIG. 1, a filling station 1 is provided which is supplied with a iilling product storage tank which is not shown. The product passes through a tubular prechamber 6 into a filling tube 2. In the vicinity of the prechamber a suction tube 4 is provided to which a slight vacuum is applied at the end of the filling process to prevent any subsequent dripping or flow of the product. The filling tube contains a coaxially reciprocatable telescopic tube 8, the upper end 10 of the telescopic tube communicating with prechamber 6 and being fixed to a piston 12 which is sealingly guided with respect to filling tube 2. The seal between filling tube 2 and piston 12 can be brought about by conventional ring seals 14. The lower end 16 of telescopic tube 8 is movable through an opening 20 in a bottom plate 18 closing the end of the filling tube. In the present case telescopic tube 8 is sealingly guided in the opening 20 of the bottom plate 18 by seals 15.

A restoring spring 24 is provided between the piston 12 and the bottom plate 18, whose spring tension is less than the filling pressure of the filling product and the frictional forces of the telescopic tube.

In the lower area of the filling tube 2, one or more vent holes 26 are provided in the side walled positioned below the bottom surface of the piston 12 which carries the telescopic tube 8, so that air in the spring chamber can escape during movement of the telescopic tube.

The outer face of the bottom plate 18 closing the filling tube end has a frustro-conical shape, as shown at 28, in the region of the outlet end 16 of the telescopic tube 8. As a result, on filling a dispensing container having a piston rod located within the container, it is possible to seize and guide the piston rod in the container. The piston rod then partly penetrates the telescopic tube and does not impede filling.

During the actual filling operation, a container 30 is placed beneath the filling tube and the latter is inserted into the container by movement of the filling tube with respect to the container 30. If the filling product is supplied under pressure, the piston 12 carrying the telescopic tube 8 is forced downwards, counter to the tension of the spring until the telescopic tube has extended into its lower position. No turbulence and air bubbles now form during the filling of the container. Underlevel filling or level filling can now take place, as a function of the control of the movement of the filling tube relative to the container, which raises the filling tube out of the container again. The filling operation is ended by applying a vacuum to suction tube 4 when the filling tube has been almost completely removed from the dispensing container. At this instant, the telescopic tube again moves into its original position due to the restoring force of the spring 24.

Figure 2A:
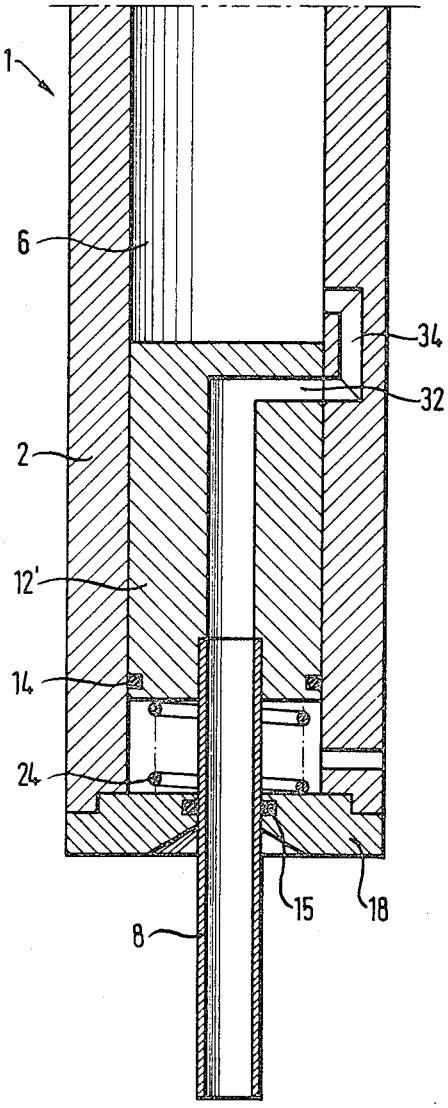
FIG. 2*a* is a sectional view of another embodiment of the filling apparatus of the invention extended for the filling process.
Figure 2B:
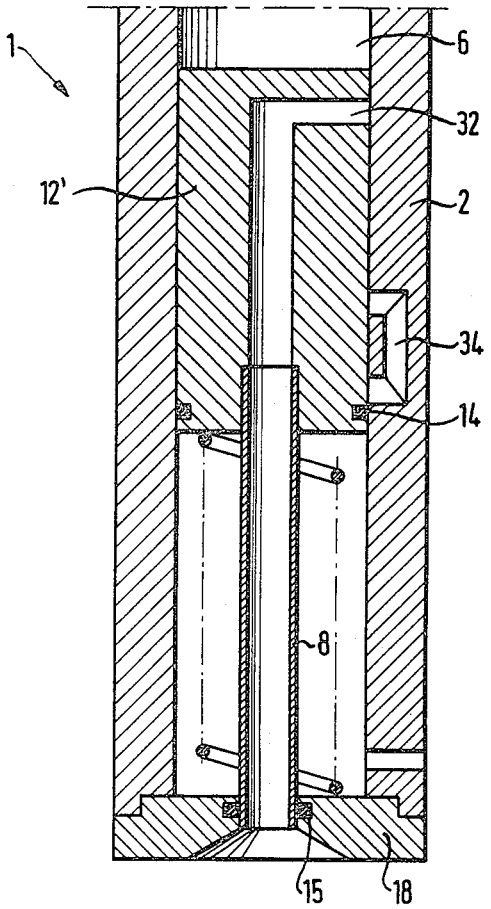
FIG. 2*b* is a sectional view of the FIG. 2*a* embodiment after the filling process has been completed.

In the embodiment of FIGS. 2*a* and 2*b*, telescopic tube 8 connects with one or more radial channels 32 in piston 12' via a coaxial extension bore in the piston. The channels 32 communicate with one or more by-pass channels 34 provided in the filling tube 2 accessible only when piston 12' is in its lowest position. These by-pass channels 34 open above piston 12' into the interior of the filling tube or are connected to the interior of the filling tube or are connected to the prechamber for as long as the piston is in its lowest position.

On removing the filling pressure, the piston again moves upwards and automatically blocks a further supply of the product to be filled to the telescopic tube.

Figure 3:
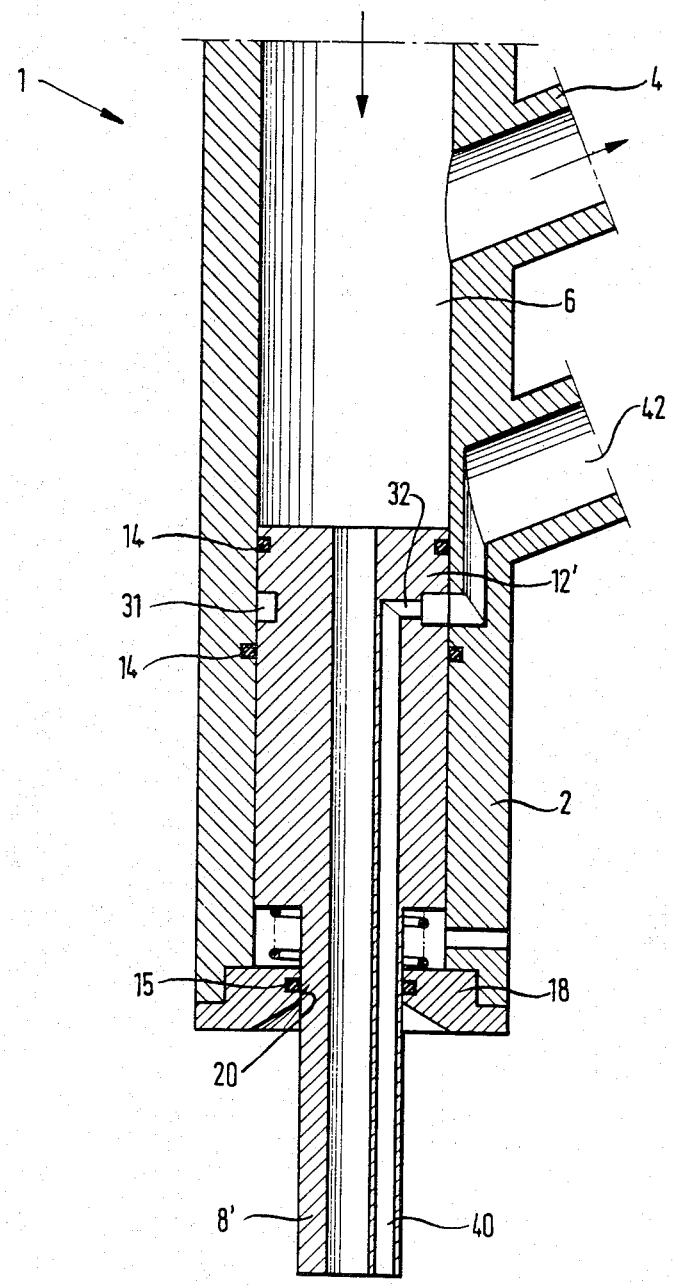
FIG. 3 is a sectional view of still another embodiment of the filling apparatus of the invention adapted for filling two different components.

In the embodiment of the apparatus shown in FIG. 3, one or more coaxial bores 40 are provided in the wall of telescopic tube 8'. At the upper end said bores 40 communicate via entension bores provided in the piston and via radially outwardly leading channels 32 with an annular slot 31 in the piston 12'. By means oi bores in the filling tube, the slot 31 is connected to one or more prechambers 42 for another filling product, for example, a differently colored toothpaste. The telescopic tube 8' is sealingly guided in the bottom plate 18 by a seal 15. A restoring spring is provided between the bottom surface of the piston 12' and the bottom plate 18 and when the filling pressure of the component being filled decreases, the piston returns to its initial position.

I claim:

1. An apparatus for filling dispensing containers with a liquid or pasty product having a filling station with a hollow filling tube having an upper and a lower end which filling tube is insertable into a dispensing container by movement of the filling tube with respect to the dispensing container, and a prechamber containing a filling product connected to the upper end of the filling tube, characterized in that a telescopic tube (8) having an upper end and a lower end is provided which is coaxially reciprocatable with respect to the filling tube (2), the upper end (10) of the telescopic tube (8) communicating with the prechamber (6) and being fixed to a piston (12) which is seaingly guided with respect to filling tube (2), and the lower end (16) of the telescopic tube is movable through an opening (20) in a bottom plate (18) closing the lower end of the filling tube and that a restoring tube (24) between the piston (12) and the bottom plate (18) is provided, whose spring tension is less than the sum of filling pressure of the filling product and the frictional forces of telescopic tube (8).

2. The apparatus according to claim 1, characterized in that the telescopic tube (8) is sealingly guided in opening (20) of the bottom plate (18).

3. The apparatus according to claim 1, characterized in that one or more vent holes (26) are provided in the lower area of filling tube (2) below the bottom surface of piston (12) which carries telescopic tube (8) in its lowest position.

4. The apparatus according to claim 1, characterized in that the outer face of the bottom plate (18) closing the lower end of the filling tube has a frustro-conical shape in the region of the outlet end (16) of the telescopic tube (8).

5. The apparatus according to claim 1, characterized in that the prechamber (6) is connected to a suction tube (4).

6. An apparatus for filling dispensing containers with a liquid or pasty product, having a filling station with a hollow filling tube having an upper and a lower end which filling tube is insertable into a dispensing conmtainer by movement of the filling tube with respect to the dispensing container, and a prechamber containing a filling product connected to the upper end of the filling tube, characterized in that a telescopic tube (8) having an upper and a lower end is provided which is coaxially reciprocatable with respect to the filling tube (2), the upper end (10) of the telescopic tube (8) communicating with the prechamber (6) and being fixed to piston (12') which is sealingly guided with respect to filling tube (2), the lower end (16) of the telescopic tube is movable through an opening (20) in a bottom plate (18) closing the lower end of the filling tube, and that a restoring spring (24) between the piston (12') and bottom plate (18) is provided, whose spring tension is less than the sum of the filling pressure of the product to be filled and the frictional forces of telescopic tube (8), and further characterized in that the telescopic tube (8) connects with one or more channels (32) arranged radially in piston (12') and which communicate with one or more by-pass channels (34) provided in filling tube (2) accessible only when piston (12') is in its lowest position and which, open above piston (12') into the interior of filling tube (2).

7. Apparatus for filling dispensing containers with a liquid or pasty product, having a filling station with hollow filling tube having an upper and lower end which filling tube is insertable into a dispensing container by movement of the filling tube with respect to dispensing container, and a prechamber containing a filling product connected to the upper end of the filling tube, characterized in that a telescopic tube (8) having an upper and a lower end is provided which is coaxially reciprocatable with respect to the filling tube (2), the upper end (10) of the telescopic tube (8) communicating with the prechamber (6) and being fixed to a piston (12') which is sealingly guided with respect to filling tube (2), the lower end (16) of the telescopic tube is movable through an opening (20) in a bottom plate (18) closing the lower end of the filling tube, and that a restoring spring (24) between the piston (12') and bottom plate (18) is provided, whose spring tension is less than the sum of filling pressure of the filling product and the frictional forces of telescopic tube (8), and further characterizewd in that the telescopic tube (8) connects with one or more channels (32) arranged radially in piston (12') and which communicates with one or more by-pass channels (34) provided in filling tube (2) accessible only when the piston (12') is in its lowest position and which, above piston (12'), are connected to prechamber (6).

8. An apparatus filling dispensing containers with a liquid or pasty product, having a filling station with a hollow filling tube having an upper and lower end which filling tube is insertable into a dispensing container by movement of the filling tube with respect to the dispensing container, and a prechamber containing a filling product connected to the upper end of the filling tube, characterized in that a telescopic tube (8') is provided which is coaxially reciprocatable with respect to the filling tube (2), the upper end (10) of the telescopic tube (8') communicating with the prechamber (6) and being fixed to piston (12') which is sealingly guided with respect to filling tube (2), the lower end (16) of is the telescopic tube is movable through an opening (20) in a bottom plate (18) closing the lower end of the filling tube, and that a restroring spring (24) between the piston (12') and bottom plate (18) is provided, whose spring tension is less than the sum of the filling pressure of the filling product and frictional forces of telescopic tube (8'), and further characterized in that in the wall of telescopic tube (8') are provided one or more coaxial bores (40), whose upper ends communicate via radially outwardly leading channels (32) with an annular slot (31) in piston (12') only when the piston (12') is in its lowest position, said slot (31) being connected via bores in the filling tube with one or more prechambers (42) for another filling product.

* * * * *